United States Patent [19]

Robin

[11] 4,212,123

[45] Jul. 15, 1980

[54] POSITIONING DEVICE

[76] Inventor: Martin I. Robin, 7616 Niles Center Rd., Skokie, Ill. 60077

[21] Appl. No.: 962,966

[22] Filed: Nov. 22, 1978

[51] Int. Cl.[2] ..... G09F 01/12

[52] U.S. Cl. ..... 40/152.1; 33/371; 33/391; 40/617; 248/495; 248/542

[58] Field of Search ..... 40/152.1, 152, 156, 40/152.2, 155, 154, 153, 158 R, 606, 607, 605, 124.2, 124, 617; 248/542, 489, 490, 495, 491, 496, 497, 498, 476–478, 479; 116/330, 331, 333; 33/391, 371, 399

[56] References Cited

U.S. PATENT DOCUMENTS

| | | | |
|---|---|---|---|
| 1,407,177 | 2/1922 | Stone | 40/152.1 |
| 1,618,237 | 2/1927 | Sturm | 33/371 X |
| 2,681,194 | 6/1954 | Halvorsen | 248/490 X |
| 2,685,859 | 8/1954 | Donnell | 248/542 X |
| 2,798,320 | 7/1957 | Montalto | 40/492 |
| 2,952,431 | 9/1960 | Pedley | 40/152.1 |
| 3,265,339 | 8/1966 | Hushek | 248/495 |
| 4,100,681 | 7/1978 | Hollander | 33/347 X |

*Primary Examiner*—John F. Pitrelli

*Attorney, Agent, or Firm*—Neuman, Williams, Anderson & Olson

[57] ABSTRACT

A positioning device is provided which is adapted to be secured to the back edge of a picture frame or the like. The device comprises a pivotally mounted indicator arm adapted to freely hang in the vertical plane when the picture frame on which disposed is in a normal hung position. When the picture frame is horizontally level no portion of the indicator arm is visible from the picture front; when the picture is not level a portion of the indicator is visible to the picture viewer.

8 Claims, 7 Drawing Figures

FIG. 1
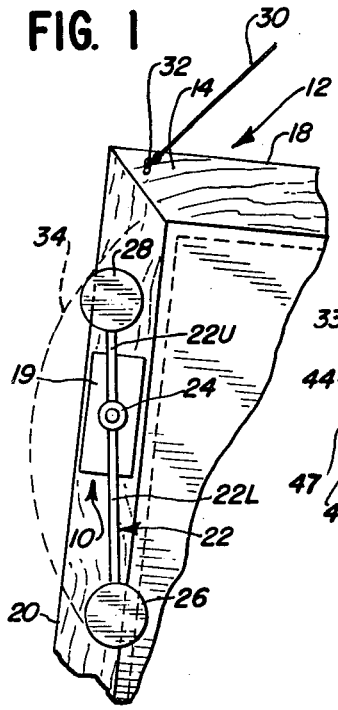
FIG. 2
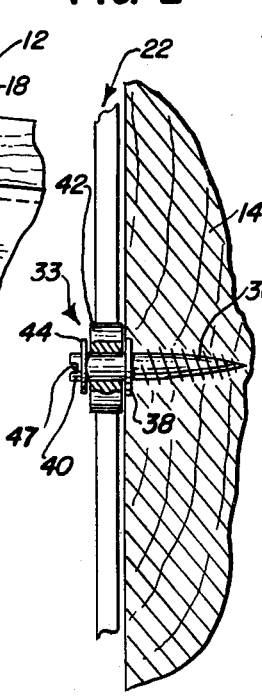
FIG. 3
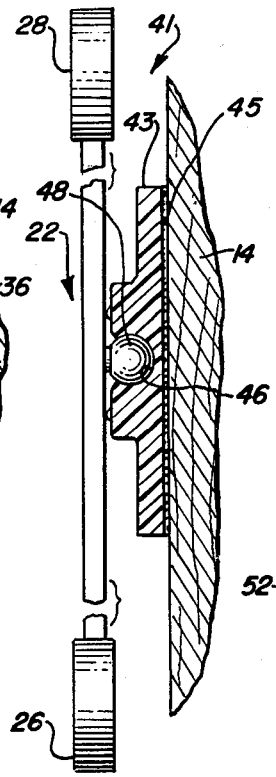
FIG. 4
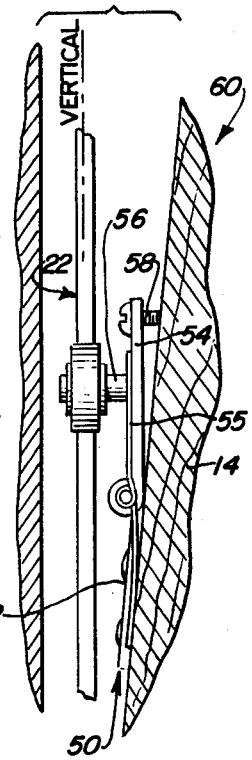
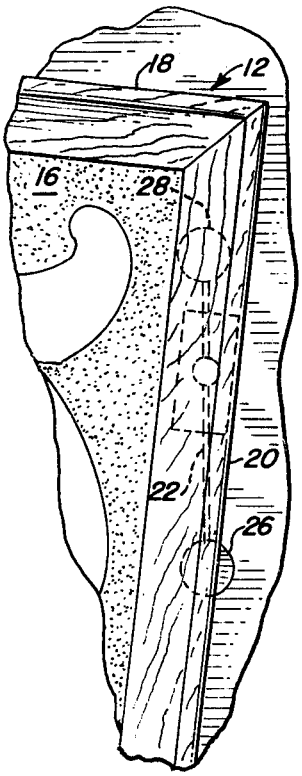
FIG. 5
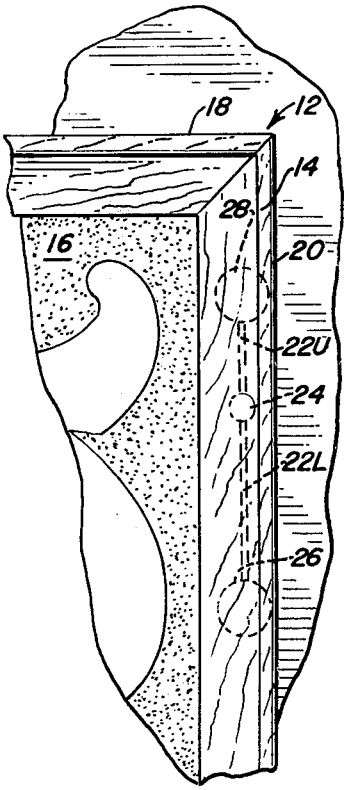
FIG. 6
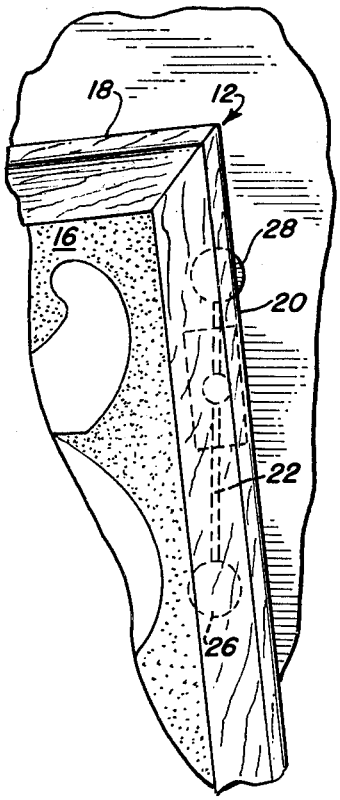
FIG. 7

POSITIONING DEVICE

This invention relates to a positioning device for a picture frame or the like, and more particularly pertains to a device which is readily attached to the rear of a picture frame for informing the picture viewer if the picture top and bottom edges are horizontal and level.

The ease with which pictures hung on a supporting wall surface may be readily removed from a desired level position in which the opposed top and bottom edges of a normal rectangular picture are parallel with the horizontal is well-known.

Accidental touching of such pictures by a passerby, vibrations as may be occasioned by a passing vehicle, or merely a daily cleaning routine may readily result in a hung picture being altered in position from its desired level condition.

Although the use of the common "bubble" level is well-known for leveling purposes, such devices are not desired for use with hanging pictures as their visual presence will detract from the desired visual impact to be imparted by the picture and frame.

Attempts of the prior art to solve this most common problem have generally involved utilization of a plurality of complex elements requiring laborious steps to finally arrive at a desired disposition in a hung picture.

Thus, Pedley U.S. Pat. No. 2,952,431 is directed to a picture frame construction comprised of intersecting strips disposed on the back of a frame. The strips must be adjusted relative to each other and fixed in a desired relationship prior to the frame being hung in the desired level condition. The picture is then suspended from a support. The positioning device of this invention is comprised of a minimum number of parts and is readily utilized for arranging a picture in a desired position on a wall.

It is an object of this invention, therefore, to provide a novel device for ready attachment to the rear of a picture and which visually informs the viewer of the front of such picture if the same is desirably positioned relative to the horizontal and vertical planes.

It is another object of this invention to provide a positioning or leveling device which is adaptable for use with pictures having peripheral configurations other than rectangular.

It is a further object of this invention to provide a flexible positioning device which may be employed with pictures supported by various means such as a single or plural supporting wires, nails, etc.

It is yet another object of this invention to provide a positioning device which may be formed with the picture at the time of manufacture and assembly or may be subsequently applied to picture frames.

The above and other objects of this invention will become more apparent from the following detailed description when read in the light of the accompanying drawing and appended claims.

In one embodiment of the picture leveling or positioning device provided by this invention, a pivoting indicator member such as is an elongate level arm, is mounted in an off-center manner whereby such member will automatically move by force of gravity into the vertical plane when the pivot on which such arm is mounted is substantially horizontally disposed. By mounting the indicator arm along one rear vertical edge of a picture frame, the indicator remains in the vertical plane regardless of the level condition of the hung picture, and will be visible from the picture front when the frame and picture are not themselves in desired disposition relative to the vertical plane.

In a specific indicator embodiment the indicator pivot has a hinge-type connection with an anchoring plate whereby such pivot may be located precisely in the horizontal plane. Such pivot adjustability offsets any angular disposition of the plane of the frame relative to the supporting wall surface as will be hereinafter explained in greater detail.

For a more complete understanding of this invention reference will now be made to the drawings wherein:

FIG. 1 is a fragmentary elevational view illustrating a positioning device made in accordance with this invention secured to a rear frame edge portion of a picture utilizing the same;

FIG. 2 is a fragmentary, longitudinal sectional view illustrating one embodiment of a modified positioning device made in accordance with this invention;

FIG. 3 is a view similar to FIG. 2 illustrating a second modified positioning device made in accordance with this invention;

FIG. 4 is a side elevational view partly in section illustrating an embodiment of a positioning device made in accordance with this invention having an adjustable pivot in a normal position of assembly on the rear of a framed picture;

FIG. 5 is a fragmentary front elevational view of a picture or the like having a positioning device made in accordance with this invention mounted on the rear vertical edge thereof and illustrating the picture in a nonhorizontal condition whereby a portion of the provided indicator is visible from the front of the picture;

FIG. 6 is a view similar to that of FIG. 5 illustrating the picture fragment in a desired vertical position; and FIG. 7 is a view similar to FIGS. 5 and 6 illustrating the picture and device assembly of FIGS. 5 and 6 with the picture titled in a direction opposite that of FIG. 5 whereby an upper portion of the provided indicator means is visible from the front of the picture.

Referring now more particularly to FIG. 1 a positioning device 10 is therein illustrated mounted on the rear surface of a framed picture 12 or the like. In connection with the provided invention, although the positioning device 10 will be described in terms of positioning or leveling a picture 12, it will be understood that the provided device 10 is adapted to function in the manner hereinafter described in detail with other objects. Thus signs, mirrors, displays and the like employed in the home, stores, industry, etc., may employ the provided invention when it is desired that such object be suspended from a supporting wall surface or equivalent support means in a desired position relative to the vertical and horizontal planes so as to provide a desired pleasing appearance.

Thus in the instance of a rectangular picture such as picture 12 having a peripheral frame 14 formed of interfitted wood segments or the like, it is desired that opposed width-defining edges 18 of the frame 14 be horizontally disposed. Only the upper edge is illustrated in the drawing. Similarly opposed vertical ridges 20 (only the left vertical edge being illustrated in the drawings) are desirably arranged parallel to the vertical plane.

It is well known that it is quite difficult on occasion, particularly when a large picture is being arranged on a supporting wall surface, to desirably suspend such a picture so that the edges of a frame of rectangular peripheral configuration, are desirably located relative to the horizontal and vertical planes in the manner previously indicated.

In accordance with this invention the position indicator 10 illustrated in FIG. 1 may be readily secured to the rear of a picture such as illustrated picture 12 as by adhesively securing base portion 19 of the device 10 on which an indicator arm 22 is pivotally mounted by means of pivot pin 24. Pivot arm 22 is composed of two segments of unequal length, namely lower segment 22L and upper segment 22U. By virtue of its longer length the indicator arm 22 will normally pivot as a result the greater weight of the lower arm 22L into the vertical position illustrated about pivot pin 24.

Thus indicator arm 22 will be self-locating in the vertical plane as illustrated in FIG. 1 when picture 12 is in its normal hung position on a supporting wall surface. Such continual vertical disposition occasioned by the forces of gravity is employed in accordance with this invention for purposes of assisting in positioning the picture 12 desirably on the supporting wall surface.

In the event the picture 12 is tilted in the manner illustrated in FIGS. 1, as well as 5 and 7, indicator arm 22 if long enough and if located close enough to the picture vertical edges 20, will project beyond such edges so as to be visible from the front of the picture.

It is thus seen that the indicator arm 22 provides a simple mechanism which is normally positioned in the vertical plane when the picture 12 is hung on a wall and which may readily serve to indicate to the viewer of the picture if the picture is not properly aligned with its vertical edges 20 in the vertical plane.

Similarly, in a rectangular picture as is picture 12 of FIG. 1, the arms 22 will indicate if the edges 18 are not horizontally disposed. To improve the visibility of the indicator arm 22 from the front of the picture 12, the indicator arm has a circular enlargement 26 attached to the lower arm segment 22L and an enlargement 28 formed integrally with the end of the upper arm segment 22U. Such enlargements are preferably colored so as to be readily noticeable from the front of the picture in the manner illustrated in FIGS. 5 and 7.

In FIG. 5 enlargement 26 is illustrated protruding beyond vertical edge 20 of the picture frame 14 owing to the tilted disposition in the vertical plane of the vertical edge 20 of the picture 12. Similarly horizontal edge 18 will be in a nonhorizontal plane in the manner illustrated in FIG. 5 because of its right angle relationship with edge 20. Indicator arm 22 in FIG. 5 is in the vertical plane as such is its normal position regardless of the angular disposition of the picture 12.

It will be noted from FIG. 6 that when viewing the front of the picture 12 with the frame edge 20 desirably in the vertical plane and with the frame edge 18 desirably in the horizontal plane, the enlargements 26 and 28 of the indicator arm 22 are completely hidden from view behind frame portion 14 of the picture 12. It is thus seen that the positioning device 10 comprises an extremely simple means for visibly indicating to the viewer of a picture whether the edges of a rectangular picture frame are desirably in the vertical and horizontal planes. It is obvious that if the picture, mirror, sign, display or the like 12 is suspended by a single wire such as wire 30 of FIG. 1 which engages spaced eyelets 32 only one being illustrated in FIG. 1, the suspended rectangular picture or the like may be readily pivotally moved about a supporting hook (not illustrated) relative to the supporting wall surface by appropriate movement of the supporting wire 30 on such support hook. This may be readily and easily carried out until the indicator enlargements are hidden from view in the manne illustrated in FIG. 6.

In the event that the supported picture 12 is of significant weight necessitating two supporting wires suspended from separate hook members, appropriate wire adjustments are made until the indicator arm enlargements 26 and 28 are hidden from view and adjacent, substantially in tangential relationship with picture edge 20 in the manner illustrated in FIG. 6.

It should be appreciated that the positioning device 10 of this invention has utility not only with pictures of normal rectangular configuration such as illustrated picture 12, but it also has utility with pictures, mirrors, signs, or the like, which may be of purely circular or other regular or irregular configuration.

Thus it will be noted from FIG. 1 that phantom line 34 indicates a peripheral fragment of a circular mirror or the like in which the provided positioning device 10 above described with respect to picture 12 may be located at the mirror rear so that the indicator arm enlargements 28 and 26 are substantially tangential with such peripheral edge 34. It is customary in the designs of many ornamental mirrors employed in the home for decorative purposes to employ emblems, figureheads, or the like at the mirror top and/or bottom. Thus, although the periphery of the mirror itself is circular, it is nevertheless desirable to locate such mirror on a supporting wall surface so that the emblem is positioned at the top of the mirror so as to be desirably located relative to the horizontal and vertical planes. By location of the base plate 20 of the device 10 in a predetermined manner on the rear of such a circular mirror or the like, the indicator arm enlargements 26 and 28 are hidden from view in adjacent, substantially tangential contact with outer periphery 34 of such mirror. Thus, such a mirror may be readily positioned on supporting wall surface utilizing the positioning device 10 in the manner above described with respect to the picture 12.

The modified positioning device 33 of FIG. 2 illustrated on a somewhat enlarged scale over the scale employed in representing positioning device 10 in FIG. 1 emphasizes the minute space occupied by positioning assemblies such as positioning device 33 which is made in accordance with this invention. Device 33 may comprise an anchor element 36 which may be a ribbed nail or threaded screw member driven into or threadably engaged with wooden frame portion 14. The depth to which the anchor element is screwed into or driven into the wooden frame portion 14 may be limited by an annular collar 38 which serves as a stop for penetration of the threaded or ribbed portion of the anchoring element into the wooden frame 14. Extending from the collar in a direction opposite to that of the ribbed or threaded portion is a smooth cylindrical portion 40 which serves as the pivot for collar 42 of illustrated indicator arm 22 which may be precisely the same construction as indicator arm 22 illustrated in FIGS. 1 and 5 through 7. Slot 41 may disposed an end of portion 40 to receive the blade of a screwdriver or the like Illustrated retainer spring 44 may be employed for retaining the indicator arm 22 of FIG. 2 in assembled relationship with the anchoring element 36. It is contemplated that the positioning devices made in accordance with this invention be disposed in adjacent relationship with the rear surface of the object to be maintained in a level position and need occupy no more than approximately three-eighths of an inch beyond the surface of the frame or the like to which attached.

The base plates of the provided positioning devices may be secured to the surface of a picture frame or the like, such as is illustrated in FIG. 1, or secured to such frame by means of a securing means such as anchoring element 36 in FIG. 2. In an alternative construction, the entire positioning assembly may be disposed in a recess formed in the rear surface of the frame or the like so that no portion of the positioning assembly need protrude beyond the plane of the remaining, unrecessed frame surface. It is, of course, apparent that suspended objects such as pictures, mirrors, signs and the like are always arranged at a slight angle relative to the plane of the supporting wall on which disposed. Such angular disposition provides a space within which the provided indicator devices of this invention may freely move without danger of striking an adjacent supporting wall surface.

Whereas the positioning devices of FIGS. 1 and 2 rely upon cylindrical pivot pins on which the indicator arms 22 are pivotally mounted, FIG. 3 illustrates a modified device 41 in which a plastic base 43 may be secured as by a layer 45 of an adhesive such as an epoxy or the like to the surface of the frame portion 14. An annular socket 46 is disposed in the plastic base 43 which is adapted to receive ball 48 attached to indicator arm 22 which is of precisely the same construction as indicator arms 22 of FIGS. 1 and 2 with the exception of its integral formation with the ball 48 which enables the arm to effect a snap-in interlock with the base 43. It is, of course, an obvious desideratum of the positioning assemblies 10, 33 and 41 of FIGS. 1 through 3 respectively that a minimum of friction be encountered in the course of movement of the indicator arms relative to its supporting pivot. Thus in the illustrated indicator constructions it is desired that the bearing surfaces be smooth and formed of a plastic, metal or other bearing material affording a minimum of frictional resistance to pivotal movement of the indicator arm 22.

As was above mentioned, in the normal suspended position a picture, mirror, sign or the like adapted to employ a positioning device of this invention normally disposed as slight angle in the nature of 12° or the like relative to the plane of the supporting wall. Assuming that a picture of extreme size and weight has mounted on the rear thereof any of the indicator assemblies previously described, it may be desirable to provide a means whereby the pivot on which the indicator arm 22 is mounted may be adjusted relative to the supporting base of the positioning device so that the pivot pin may be located in precisely the horizontal plane.

As a result, the forces of gravity will act directly on the heavier indicator arm 22L and the arm 22 will pivot freely in a desirable manner about its pivot. Such an adjustment means may comprise a hinge-like base plate such as base plate 50 of FIG. 4 secured to the rear of a picture 60 on which an anchor hinge portion 52 is secured to the picture frame 14 whereas a hinge portion 54 pivotally movable relative to anchor portion 52 has a pivot pin 56 mounted thereon. Thus the hinge portion 54 may be precisely adjusted by means of an adjusting screw 58 or the like, so as to insure that hinge portion 54 loaded by spring 55 is desirably in the vertical plane and mounted pivot pin 56 is desirably in the horizontal plane when picture 60 which may be disposed at a substantial angle to the supporting wall surface is in its normal hung position. Hinge portion 54 may be spring biased in any well-known manner in the direction of the picture 60. Adjusting screw 58 will then be employed to threadably move relative to the hinge portion 54 on which threadedly mounted for purposes of precisely moving hinge portion 54 into a desired angular relationship with anchoring hinge portion 52.

It is believed apparent, therefore, from the foregoing description that a simple positioning device is provided which is readily secured to the rear of a picture, mirror or the like so that such picture may be desirably hung with its edges, in the case of a rectangular picture desirably disposed in the horizontal and vertical planes. As was mentioned with respect to the arcuate object 34 or the like, the provided positioning assemblies may be employed regardless of the peripheral configuration of the object to which attached to secure proper location of such object relative to the vertical plane. It is further apparent that the indicator arms 22 may be of any irregular configuration as may be dictated by the periphery of the object which attached. Thus, the indicator arm 22 may be straight or it may be curvilinear or irregular along its length to conform with a curvilinear or irregular edge of a picture or the like to which secured.

It is, of course, essential that regardless of the indicator arm configuration, that the same be so constructed to always assume a predetermined arrangement relative to the vertical plane when freely pivoting about its supporting pivot point. Thus although the indicator arm 22 of the drawings comprises an arm composed of unequal segments extending from the pivot point, it is quite obvious that the indicator arm segments need only be of unequal weight. Accordingly, a shorter indicator arm may be disposed lowermost if weighing more than a longer arm which would tend to be uppermost, when such arm is subjected to normal gravitational forces as when the assembly is arranged in the vertical plane with the supporting pivot disposed in the horizontal plane as is the desired condition in the normal position of use.

As was above brought out, the normal angular disposition of the hung picture or mirror or the like is such as to allow the indicator arms of this invention to freely pivot and, accordingly, the hinge construction of FIG. 4 is not essential in all embodiments of the provided invention. The provided positioning assemblies may be formed at the time of picture construction and sold as an integral element of the picture, or the provided construction may be sold as a separate item for the securement by the picture owner to the rear of a picture, mirror or the like already in the home.

It is believed that the foregoing has been made apparent many modifications in the structure which will remain within the ambit of the invention disclosed. This invention, therefore, is only to be limited by the scope of the claims.

What is claimed is:

1. In combination, an object such as a picture frame, mirror or the like for suspending substantially in the vertical plane having a normally visible front surface and an opposed, normally hidden rear surface; indicator means for indicating whether said object is desirably suspended relative to the horizontal plane mounted on said object rear surface; a suspension point mounted on said object rear surface on which said indicator means is supportably mounted; said suspension point comprising a pivot enabline said indicator means to freely hang in a predetermined manner in the vertical plane regardless of the disposition of said object relative to the horizontal plane while said object is suspended substantially in the vertical plane; said indicator means being located relative to the periphery of said object so as to be hidden from view when viewing the front surface of said object when said object is suspended in substantially the vertical plane with said object at a predetermined angular disposition relative to the horizontal plane; said indicator means being visible when viewing the front surface of said object while suspended in substantially the vertical plane when said object is not in said predetermined angular disposition relative to the horizontal plane.

2. The combination of claim 1 in which said pivot is adjustably positioned relative to the vertical plane.

3. In combination, an object such as a picture frame, mirror or the like for suspending in substantially the vertical plane having a normally visible front surface and an opposed, normally hidden rear surface; indicator means pivotally supportably mounted on said normally hidden rear surface for visibly indicating to a viewer of said first surface when said object is in a particular orientation relative to the horizontal plane while suspended in said substantially vertical plane; said indicator means being pivotally mounted on said normally hidden surface and hidden behind said normally visible surface when said object is suspended substantially in the vertical plane in said particular orientation, and being visible by projecting from behind the periphery of said normally visible surface when said object is suspended in the vertical plane and is not in said particular orientation relative to the horizontal plane.

4. In combination, an object such as a picture frame, mirror or the like for suspending in substantially the vertical plane and having a normally visible surface and an opposed normally hidden surface; indicator means supportably mounted on said normally hidden surface having a peripheral portion in registration with a peripheral portion of said object so as to be hidden from view when said normally visible surface is viewed with said object suspended in substantially the vertical plane and said object is suspended in a particular disposition relative to the horizontal plane; said indicator means being visible by projecting from behind a peripheral portion of said object when said normally visible surface is viewed with said object suspended in substantially the vertical plane and said object is not in said particular disposition relative to the horizontal plane; said indicator means assuming a substantially constant angular disposition relative to the vertical plane which is independent of said object disposition relative to the horizontal plane when said object is suspended in substantially the vertical plane.

5. The combination of claims 1, 3 or 4 in which said indicator means has unequal arms extending from a juncture pivotally supportably mounted on the normally hidden surface of said object.

6. The combination of claim 5 in which said indicator arms are of unequal length; each of said arms having an enlargement disposed at an end portion thereof.

7. The combination of claim 5 in which indicator arms are of unequal weight and have enlargements disposed at end portions thereof.

8. The combination of claims 3 or 4 in which said indicator means are pivotally mounted on a pivot supported by said normally hidden surface; and means interconnect said pivot and said normally hidden surface for adjustably positioning said pivot relative to the vertical plane.

* * * * *

UNITED STATES PATENT AND TRADEMARK OFFICE

CERTIFICATE OF CORRECTION

PATENT NO. : 4,212,123

DATED : July 15, 1980

INVENTOR(S) : Martin I. Robin

It is certified that error appears in the above-identified patent and that said Letters Patent are hereby corrected as shown below:

Column 2, line 38, change "titled" to -- tilted --

Column 4, line 3, change "manne" to -- manner --

Column 6, line 64, change "enabline" to -- enabling --

Signed and Sealed this

*Twenty-eighth* Day of *October 1980*

[SEAL]

*Attest:*

SIDNEY A. DIAMOND

*Attesting Officer*

*Commissioner of Patents and Trademarks*